US008856973B2

(12) United States Patent
Jourde et al.

(10) Patent No.: US 8,856,973 B2
(45) Date of Patent: Oct. 14, 2014

(54) GOALIE HELMET WITH NOVEL STRAP CONFIGURATION

(75) Inventors: Bastien Jourde, Montreal (CA); Martin Laberge, Montreal (CA); Sebastien Morin, Montmagny (CA)

(73) Assignee: Sport Maska Inc., Montreal (CA)

( * ) Notice: Subject to any disclaimer, the term of this patent is extended or adjusted under 35 U.S.C. 154(b) by 1327 days.

(21) Appl. No.: 12/318,822

(22) Filed: Jan. 9, 2009

(65) Prior Publication Data

US 2009/0113606 A1 May 7, 2009

Related U.S. Application Data

(63) Continuation-in-part of application No. 11/586,678, filed on Oct. 26, 2006, now abandoned.

(51) Int. Cl.
*A42B 1/22* (2006.01)
*A42B 3/20* (2006.01)
*A42B 3/08* (2006.01)

(52) U.S. Cl.
CPC .... *A42B 3/08* (2013.01); *A42B 3/20* (2013.01)
USPC ..... 2/417; 2/420

(58) Field of Classification Search
USPC ..... 2/417, 420, 424, 425, 410, 419, 418, 2/423
See application file for complete search history.

(56) References Cited

U.S. PATENT DOCUMENTS 1,079,080 A * 11/1913 Ward ..... 24/170
2,710,965 A * 6/1955 Bowers ..... 2/417
2,758,306 A * 8/1956 Grancsay et al. ..... 2/419
2,768,380 A * 10/1956 Golomb ..... 2/420
2,964,754 A * 12/1960 Austin ..... 2/417
3,042,927 A * 7/1962 Mauro et al. ..... 2/418
3,087,166 A * 4/1963 Howard ..... 2/420
3,221,340 A * 12/1965 Joffe ..... 2/417
3,373,442 A 3/1968 Belanich et al.
3,373,443 A * 3/1968 Marietta ..... 2/9
3,608,158 A * 9/1971 Bengtsson ..... 24/170
3,729,745 A * 5/1973 Latina ..... 2/9
3,732,574 A * 5/1973 Hale ..... 2/9
3,852,822 A * 12/1974 Watkins et al. ..... 2/417
4,209,858 A * 7/1980 Coenen ..... 2/412
4,279,037 A 7/1981 Morgan
4,477,929 A * 10/1984 Mattsson ..... 2/425
5,469,583 A * 11/1995 Akeley et al. ..... 2/421
5,621,923 A * 4/1997 Tapocik ..... 2/422
5,659,900 A * 8/1997 Arney et al. ..... 2/417
5,694,649 A * 12/1997 Hefling et al. ..... 2/418
5,887,288 A * 3/1999 Arney et al. ..... 2/421
5,898,950 A * 5/1999 Spyrou et al. ..... 2/421
5,953,761 A * 9/1999 Jurga et al. ..... 2/425
6,189,156 B1 * 2/2001 Loiars ..... 2/424
6,266,827 B1 * 7/2001 Lampe et al. ..... 2/414
6,279,172 B1 * 8/2001 Epperson et al. ..... 2/410
6,311,338 B1 * 11/2001 Galet ..... 2/421
6,324,700 B1 * 12/2001 McDougall ..... 2/417

(Continued)

*Primary Examiner* — Richale Quinn

(74) *Attorney, Agent, or Firm* — Norton Rose Fulbright Canada

(57) ABSTRACT

A sports helmet having a front shell and a rear shell, and a plurality of straps interconnecting the front and rear shells. At least one of the straps is connected to the front shell along an inner surface thereof, and a portion of the at least one of the straps extending from the rear shell to the connection with the front shell is completely contained inside the helmet.

20 Claims, 8 Drawing Sheets

(56) References Cited

U.S. PATENT DOCUMENTS 6,701,535 B2 * 3/2004 Dobbie et al. ..... 2/422
6,820,286 B2 * 11/2004 Paul et al. ..... 2/425
2004/0040073 A1 * 3/2004 Morrow et al. ..... 2/424
2008/0189835 A1 * 8/2008 Mangone ..... 2/420

* cited by examiner

GOALIE HELMET WITH NOVEL STRAP CONFIGURATION

CROSS-REFERENCE TO RELATED APPLICATION

The present application is a continuation in part of U.S. application Ser. No. 11/586,678, filed Oct. 26, 2006, now abandoned which is incorporated by reference herein.

FIELD OF THE INVENTION

The present invention relates to helmets, particularly to goalie helmets used in contact sports such as hockey.

BACKGROUND ART

Typical goalie helmets are usually formed of a mask and a back plate which cooperate to substantially surround the head of the wearer. The back plate and mask are generally interconnected by a plurality of straps which extend along an outer surface of the back plate and are received in slots defined through the mask along a rear edge thereof. A substantial portion of the straps is left exposed and can be subject to damage or become entangled during use. In addition, adjustment mechanisms provided on prior art helmets are generally cumbersome, so that the goalie can necessitate the help of another person to adequately adjust his or her helmet.

Accordingly, improvements are desirable.

SUMMARY OF INVENTION

It is therefore an aim of the present invention to provide an improved sports helmet, particularly an improved goalie helmet.

Therefore, in accordance with the present invention, there is provided a goalie helmet comprising a mask adapted to cover a front portion of a head and a face of a wearer, the mask including a window defined therein for minimizing an interference of the mask with a vision of the wearer, a back plate adapted to cover a rear portion of the head of the wearer, the back plate and the mask cooperating to substantially enclose the head of the wearer, and a plurality of straps interconnecting the back plate and the mask, at least one of the straps being connected to the mask along an inner surface thereof.

Also in accordance with the present invention, there is provided a sports helmet comprising a front shell adapted to cover a front portion of a head of a wearer, a rear shell adapted to cover a rear portion of the head of the wearer, the rear shell cooperating with the front shell to surround the head, and a plurality of straps interconnecting the front and rear shells, the straps being connected to the front shell along an inner surface thereof.

Further in accordance with the present invention, there is provided a method of assembling a goalie helmet, comprising attaching one end of each of a plurality of straps to an inner surface of a mask of the helmet, attaching a respective adjustment member for each of the straps to a back plate of the helmet, and engaging an opposed end of each of the straps with the respective adjustment member.

Still further in accordance with the present invention, there is provided a goalie helmet comprising a mask adapted to cover a front portion of a head and a face of a wearer, the mask including a window defined therein for minimizing an interference of the mask with a vision of the wearer, a back plate adapted to cover a rear portion of the head of the wearer, the back plate and the mask cooperating to substantially enclose the head of the wearer, and a plurality of straps interconnecting the back plate and the mask, each of the straps having a first portion defined between the back plate and a connection of the strap with the mask, the connection of at least one of the straps being defined along an inner surface of the mask, the first portion of the at least one of the straps being completely contained inside the helmet.

Also in accordance with the present invention, there is provided a sports helmet comprising a front shell adapted to cover a front portion of a head of a wearer, a rear shell adapted to cover a rear portion of the head of the wearer, the rear shell cooperating with the front shell to surround the head, and a plurality of straps interconnecting the front and rear shells, at least one of the straps being connected to the front shell along an inner surface thereof, a portion of the at least one of the straps extending from the rear shell to the connection with the front shell being completely contained inside the helmet.

BRIEF DESCRIPTION OF THE DRAWINGS

Reference will now be made to the accompanying drawings, showing by way of illustration a particular embodiment of the present invention and in which.

DETAILED DESCRIPTION OF PARTICULAR EMBODIMENTS

Figure 1:
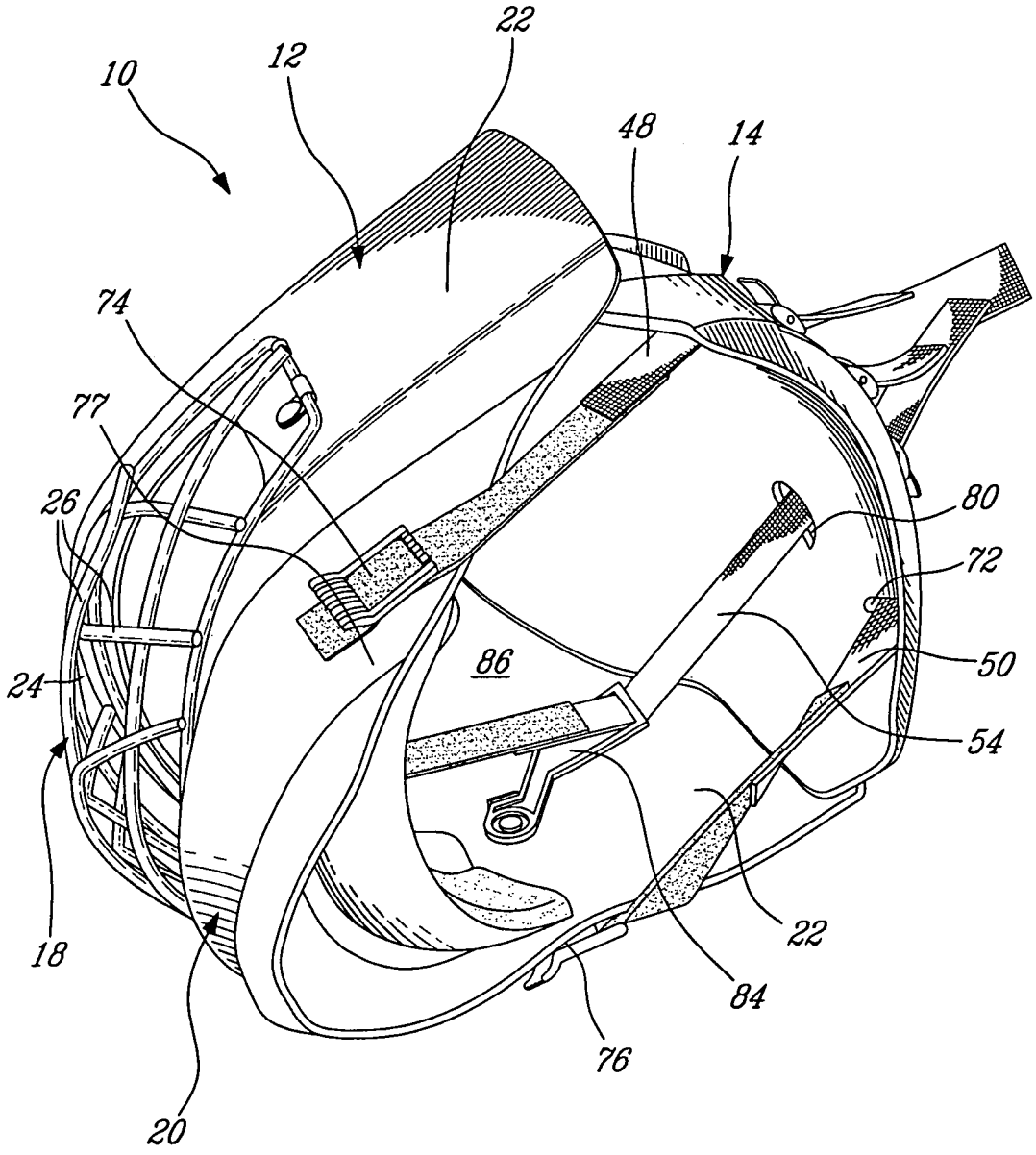
FIG. 1 is a bottom perspective view of a goalie helmet in accordance with a particular embodiment of the present invention, with an inner padding layer thereof removed for improved clarity.

Referring now to the drawings, a hockey goalie helmet is generally shown at 10. Although the invention is shown and described as being applied to a hockey goalie helmet, it is understood that the invention can be applied to other types of helmets, such as for example lacrosse helmets, baseball helmets and football helmets.

Figure 2:
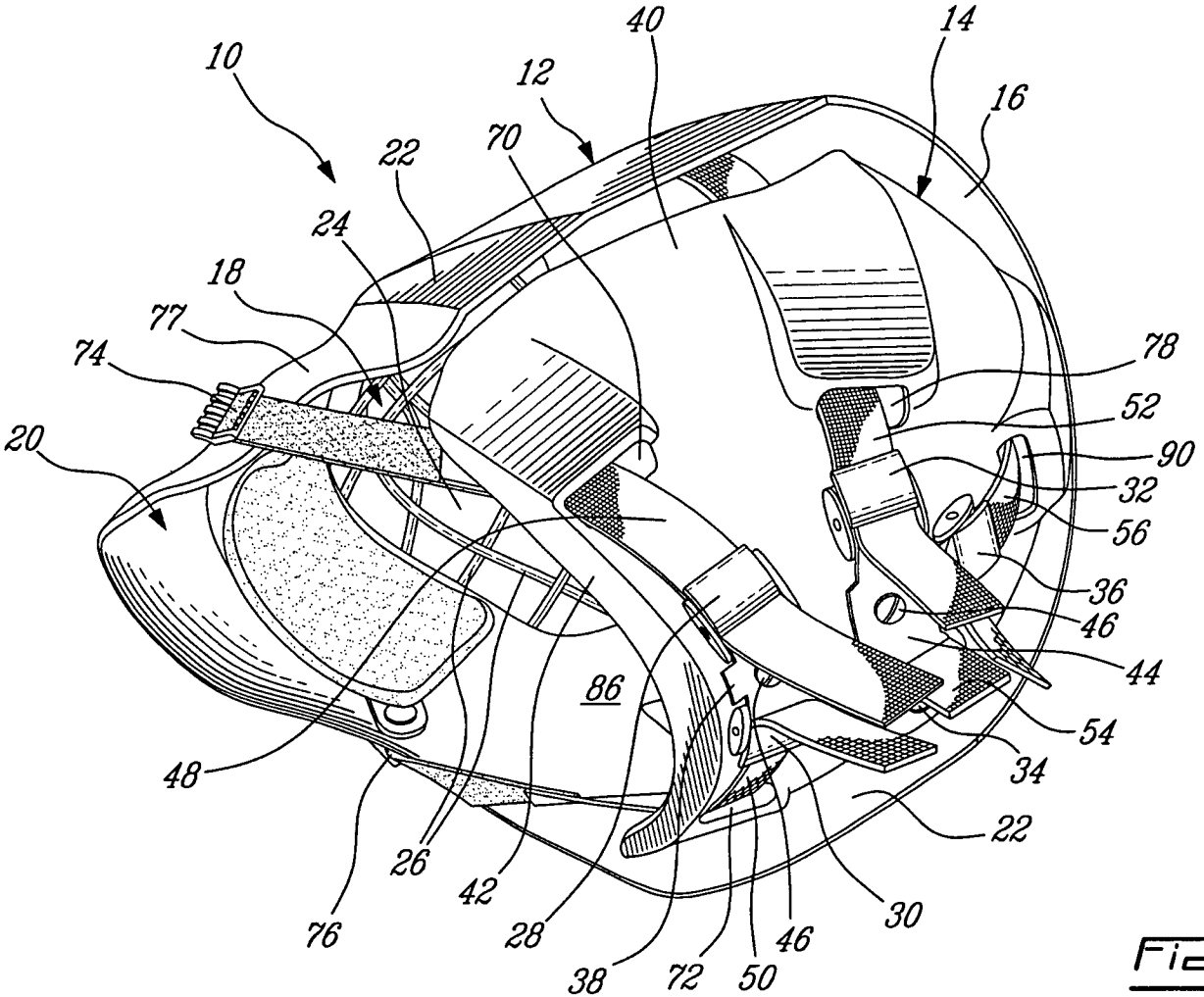
FIG. 2 is a rear perspective view of the goalie helmet of FIG. 1.
Figure 3:
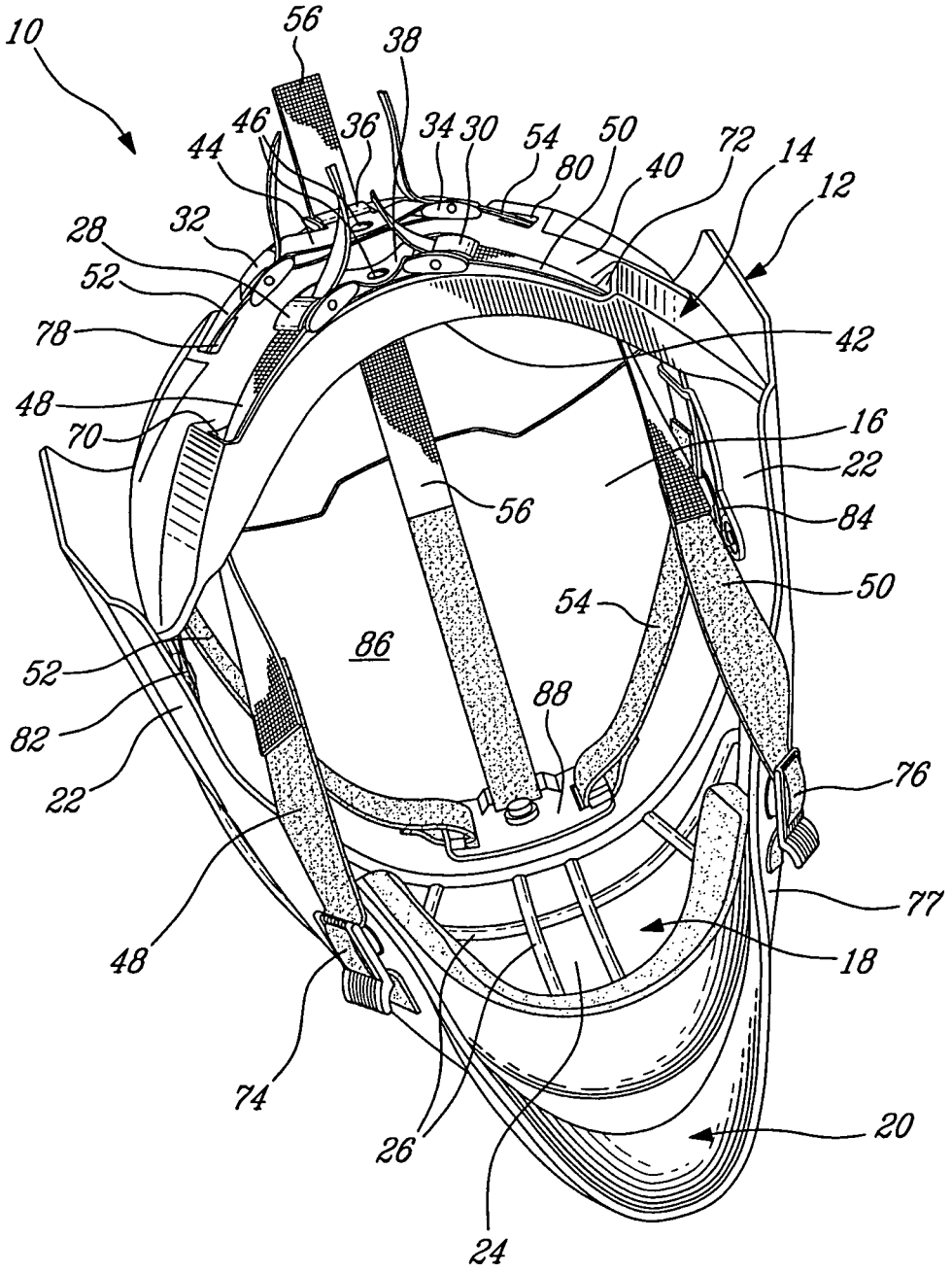
FIG. 3 is a bottom view of the goalie helmet of FIG. 1.

The helmet 10 comprises a front shell or mask 12, and a rear shell or back plate 14, which cooperate to surround the head of the wearer. In the embodiment shown, the mask 12 is adapted to substantially protect the face as well as a front portion of the head of the wearer. The mask 12 thus includes a top mask portion 16 (FIGS. 2-3) covering part of the top of the head, a front mask portion 18 (FIGS. 1-3) extending from the top mask portion 16 over a major part of the face, a bottom mask portion 20 protruding from the front mask portion 18 below the head to protect the jaw and neck, and side mask portions 22 extending between the top and bottom mask portions 16, 20 on each side of the front mask portion 18 to cover the ears and rear part of the jaw. As can be seen in FIGS. 1-3, the front mask portion 18 includes a window 24 defined therethrough, such as to minimize the interference of the mask 12 with the wearer's vision. A plurality of protection members 26 extend across the window 24 in criss-crossing fashion to prevent entry of foreign objects such as pucks therethrough.

The back plate 14 is adapted to substantially cover a rear part of the head of the wearer, and in use extends partly inwardly of the mask 12 such as to ensure covering of the head at the junction between the mask 12 and back plate 14.

The mask 12 and back plate 14 can be made of any type of adequate material, including but not limited to fiber reinforced materials, thermoplastics, and a combination thereof.

Referring to FIGS. 2-3, the back plate 14 includes an adjustment mechanism comprising left and right lower adjustment members 28, 30, left and right upper adjustment members 32, 34 and a top adjustment member 36. The lower adjustment members 28, 30 are connected, preferably in an integral fashion, to a lower plate 38 which is attached on an outer surface 40 of the back plate 14 in proximity of a center of a lower edge 42 thereof. The upper adjustment members 32, 34 and top adjustment member 36 are connected, also preferably in an integral fashion, with an upper plate 44 which is attached to the outer surface 40 of the back plate 14 upwardly offset from the lower plate 38. The lower and upper plates 38, 44 are attached to the back plate 14 by any type of adequate means, such as for example a respective screw 46.

The mask 12 and back plate 14 are interconnected by left and right lower side straps 48, 50 respectively received in the left and right lower adjustment members 28, 30, left and right upper side straps 52, 54 respectively received in the left and right upper adjustment members 32, 34, and a top strap 56 received in the top adjustment member 36.

Figure 4:
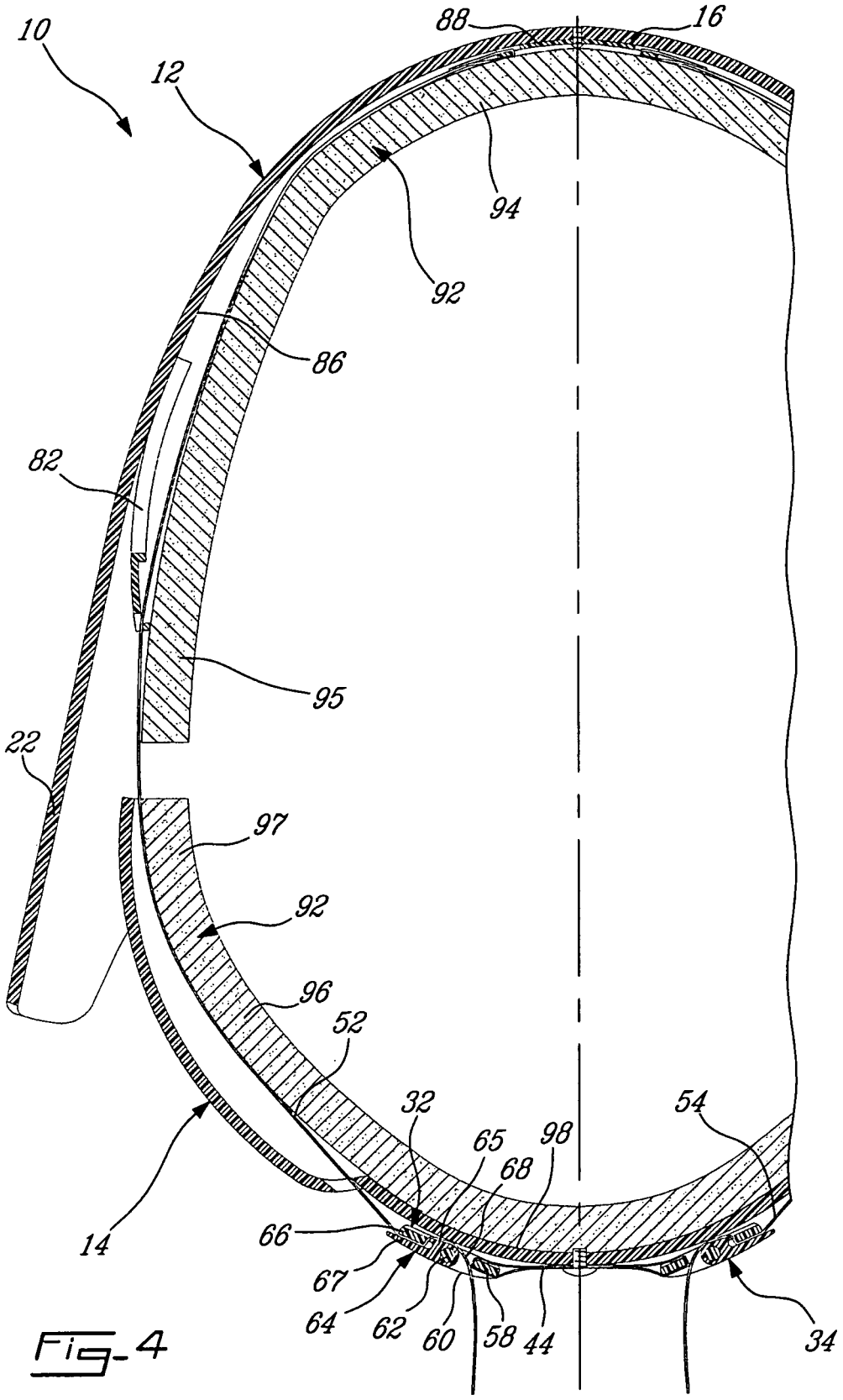
FIG. 4 is a cross-section of the goalie helmet of FIG. 1 shown with the inner padding layer.

Referring to FIG. 4, a particular embodiment of the upper left adjustment member 32 is shown and will be described herein, the remaining adjustment members 28, 30, 34, 36 being identical to the upper left adjustment member 32. The upper left adjustment member 32 includes a first fixed member 58 attached to the upper plate 44, two parallel arms 60 extending from opposed sides of the first fixed member 58, and a pivot 62 and second fixed member 66 extending between the two arms 60. The pivot 62 is located between the fixed members 62, 66 in spaced apart relationship therewith. A pinching member 64 includes a cam 65 pivotally received on the pivot 62 and a finger 67 extending from the cam 65. The pinching member 64 is pivotable between a closed position where the finger 67 lies against the second fixed member 66, and an open position where the finger 67 is away from the second fixed member 66.

A free space 68 is defined between the first fixed member 58 and the cam 65, through which the strap 52 extends. The strap 52 then passes between the cam 65 and the back plate 14, between the cam 65 and the second fixed member 66, and between the finger 67 and the second fixed member 66. The shape of the cam 65 and its position relative to the second fixed member 66 is such that the pinching member 64 is frictionally retained in the closed position, thus pinching the strap 52 between the finger 67 and the second fixed member 66.

As such, the pinching member 64 is manually disengaged from the closed position when the length of the strap 52 extending between the mask 12 and the back plate 14 needs to be adjusted. With the pinching member 64 pivoted away from the closed position, the strap 52 is free to move between the finger 67 and the second fixed member 66, thus allowing the strap 52 to be pulled in either direction to adjust a length thereof. The pinching member 64 is then returned to its closed position against the second fixed member 66 when the desired length for the strap 52 is reached.

As such, the helmet 10 can be adjusted while on the head of the wearer, simply by reaching the adjustment members 28, 30, 32, 34, 36, disengaging the respective pinching member 64 from its closed position, adjusting the length of the respective strap 28, 30, 32, 34, 36, and re-engaging the respective pinching member 64 in its closed position.

It is understood that a number of alternate adjustment members can be used, as long as each adjustment member 28, 30, 32, 34, 36 is able to retain the respective strap 48, 50, 52, 54, 56 at a desired length and to allow that desired length to be changed. In an alternate embodiment, the straps 48, 50, 52, 54, 56 are made of an elastic material and the adjustment members 28, 30, 32, 34, 36 can be omitted.

Referring to FIGS. 1-3, the left and right lower side straps 48, 50 respectively extend from the left and right lower adjustment members 28, 30 through left and right lower holes 70, 72 defined through the back plate 14. The left and right lower side straps 48, 50 are then connected, preferably in a detachable fashion, respectively to left and right attachment points 74, 76 defined in an outer surface 77 of the bottom mask portion 20. The detachable connection between the mask 12 and the lower side straps 48, 50 can be made for example through a respective snap type fastener.

Referring to FIGS. 2-3, the left and right upper side straps 52, 54 respectively extend from the left and right upper adjustment members 32, 34 through left and right upper holes 78, 80 defined through the back plate 14. The left and right upper side straps 52, 54 then respectively pass through left and right guiding members 82, 84 (see FIGS. 1 and 4) which extend from an inner surface 86 of the mask 12 along a respective one of the side mask portions 22. Referring particularly to FIG. 3, the upper side straps 52, 54 are then attached to a same connection member 88, which is in turn connected to the inner surface 86 of the mask 12 in a part of the top mask portion 16 which is adapted to extend substantially over the forehead of the wearer, i.e. which is adjacent the window 24.

The top strap 56 extends from the top adjustment member 36 through a top hole 90 (see FIG. 2) defined through the back plate 14 and is connected to the connection member 88 (see FIG. 3) together with the upper side straps 52, 54.

Referring to FIG. 4, the helmet 10 further includes an inner padding layer 92, which comprises a mask padding layer 94 secured to the inner surface 86 of the mask 12, and a back plate padding layer 96 secured to an inner surface 98 of the back plate 14. The mask padding layer 94 is secured to the inner surface 86 of the mask 12 along a portion thereof only, for example along a portion receiving the connecting member 88. As such, free portions 95 of the mask padding layer 94 extending over the top mask portion 16 and the side mask portions 22 are free to move relative thereto. Similarly, the back plate padding layer 96 is secured to the inner surface 98 of the back plate 14 along a portion thereof only, for example along a portion receiving the lower and upper plates 38, 44. As such, free portions 97 of the back plate padding layer 96 are free to move relative to the back plate 14.

The inner padding layer 92 can be made of any type of appropriate material, including but not limited to foam, fabric, an adequate polymer, a Styrofoam-type material, or any other material that may serve to absorb and/or limit the effects of a force applied on the helmet and/or provide comfort to the wearer.

The upper and top straps 52, 54, 56 extend along the inner surface 98 of the back plate 14 between the back plate 14 and the free portions 95 of the back plate padding layer 96, and along the inner surface 86 of the mask 12 between the mask 12 and the free portions 97 of the mask padding layer 94. As such, tensioning of the straps 52, 54, 56 presses the free portions 95, 97 of the inner padding layer 92 against the head of the wearer, thus providing a tighter fit of the helmet 10 around the head.

The helmet 10 thus presents several advantages. For example, the straps 48, 50, 52, 54, 56 principally extend within the helmet 10, and as such have a minimal risk of becoming entangled with other equipment or damaged during play. The adjustment members 28, 30, 32, 34, 36 provide for an easy adjustment between the mask 12 and back plate 14, such that the wearer can put the helmet 10 on and adjust it without outside help. The upper and top straps 52, 54, 56 extending between the inner padding layer 92 and the helmet 10 provide for an improved fit of the helmet 10 by adjusting the inner padding layer 92 around the wearer's head, which increases safety and comfort.

Figure 5:
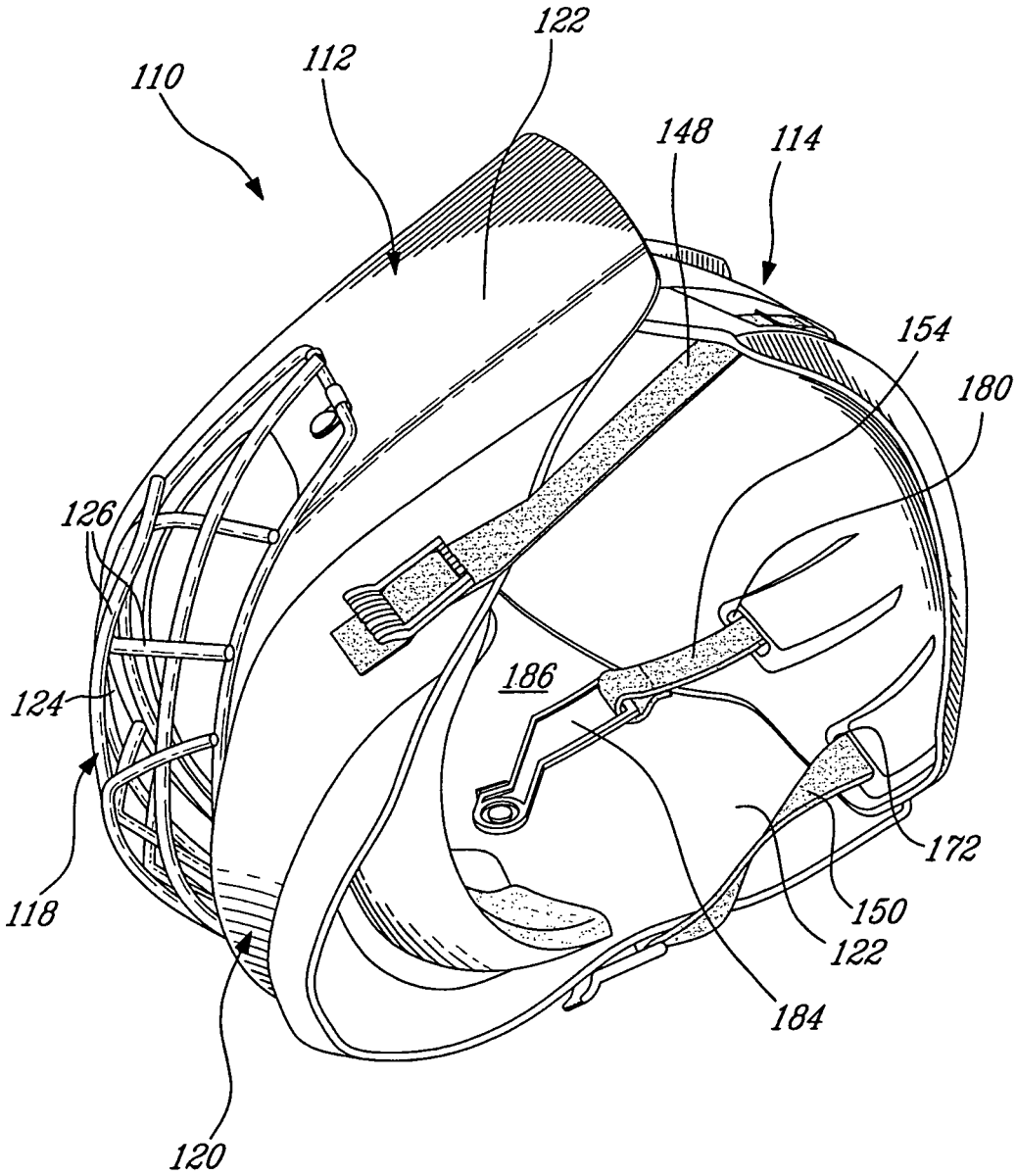
FIG. 5 is a bottom perspective view of a goalie helmet in accordance with an alternate embodiment of the present invention, with an inner padding layer thereof removed for improved clarity.
Figure 6:
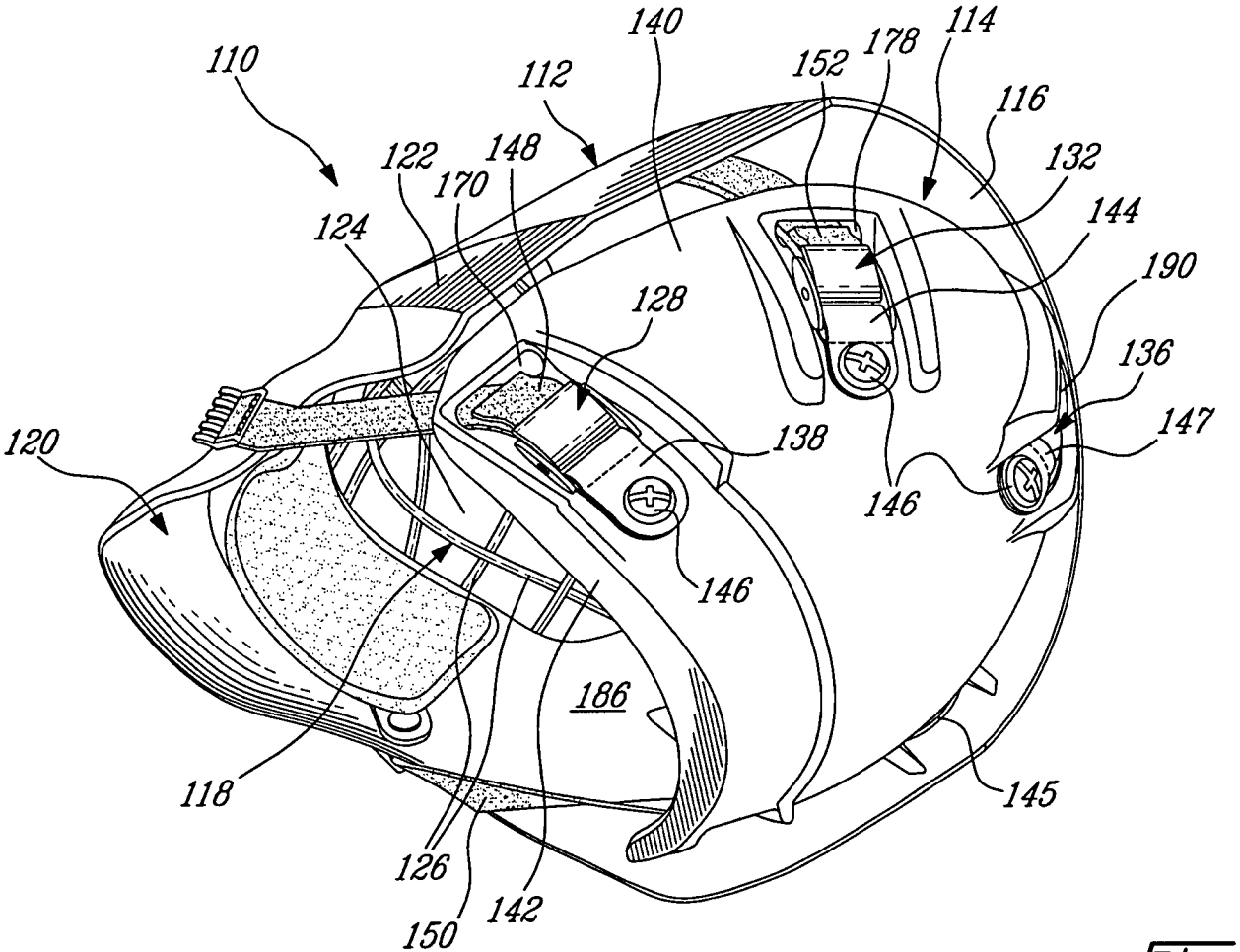
FIG. 6 is a rear perspective view of the goalie helmet of FIG. 5.
Figure 7:
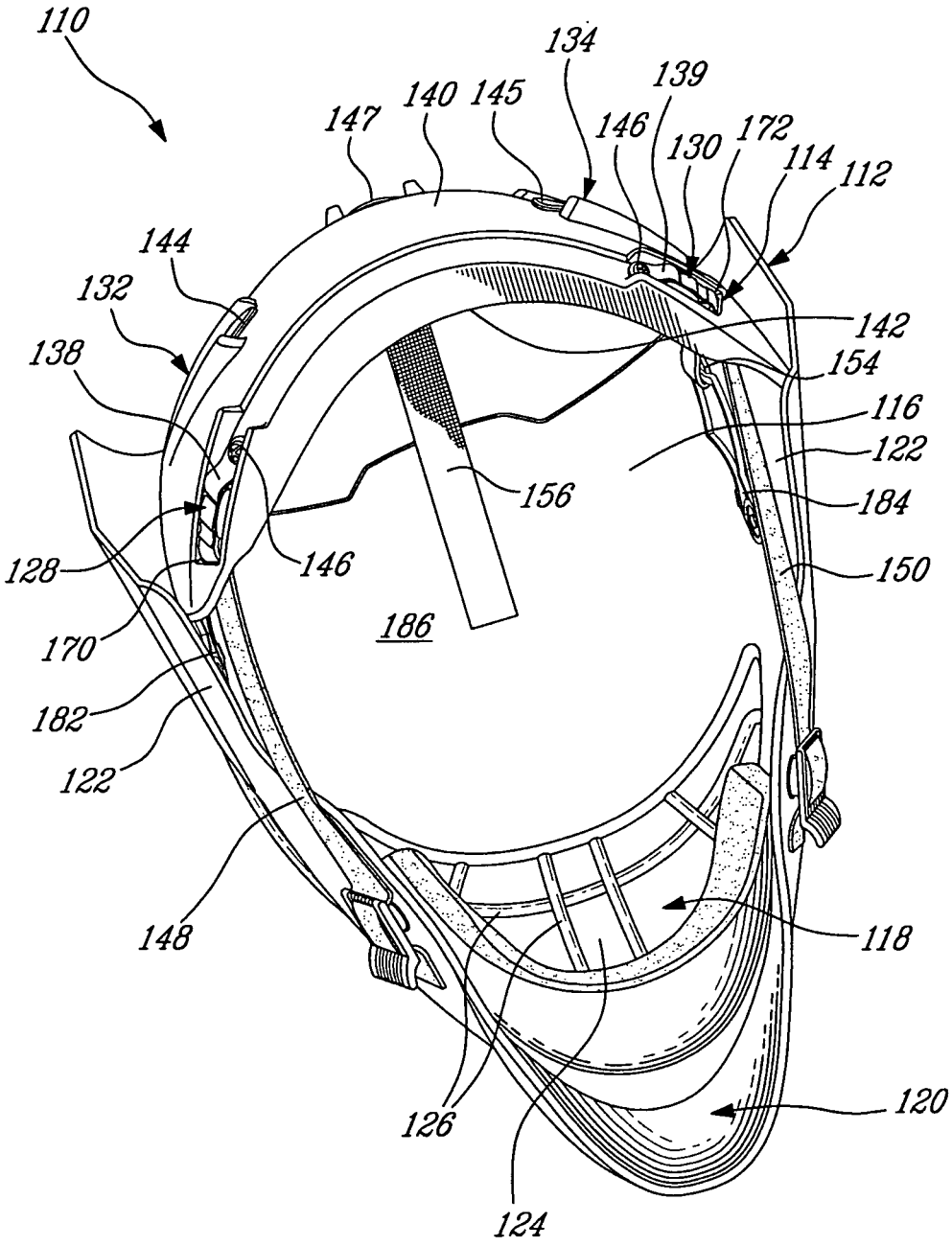
FIG. 7 is a bottom view of the goalie helmet of FIG. 5.

Referring to FIG. 5, a helmet 110 according to an alternate embodiment is shown. The helmet 110 comprises a front shell or mask 112, and a rear shell or back plate 114, which cooperate in the same manner as described above with respect to the helmet 10. The mask 112 has a top mask portion 116, a front mask portion 118 extending from the top mask portion 116, a bottom mask portion 120 protruding from the front mask portion 118, and side mask portions 122 extending between the top and bottom mask portions 116, 120 on each side of the front mask portion 118. As can be seen in FIGS. 5-7, the front mask portion 118 includes a window 124 and a plurality of protection members 126 extending across the window 124 in criss-crossing fashion.

Referring to FIGS. 6-7, the back plate 114 includes an adjustment mechanism comprising left and right lower adjustment members 128, 130, left and right upper adjustment members 132, 134 and a top adjustment member 136. The lower adjustment members 128, 130 are connected respectively to lower left and right side plates 138, 139 which are attached to an outer surface 140 of the back plate 114 in proximity of opposite ends of a lower edge 142 thereof. The upper left adjustment member 132 is connected to an upper left side plate 144 which is attached to the outer surface 140 of the back plate 114 upwardly offset from the lower left side plate 138. The upper right adjustment member 134 is connected to an upper right side plate 145 which is attached to the outer surface 140 of the back plate 114 upwardly offset from the lower right side plate 139. The top adjustment member 136 is connected to a top side plate 147 upwardly offset from and aligned between the left and right upper side plates 144, 145. The plates 138, 139, 144, 145, 147 may be attached to the back plate 114 in a similar manner as the plates 38, 44 of the previous embodiment, for example through a respective screw 146.

The mask 112 and back plate 114 are interconnected by left and right lower side straps 148, 150 respectively received in the left and right lower adjustment members 128, 130, left and right upper side straps 152, 154 respectively received in the left and right upper adjustment members 132, 134, and a top strap 156 received in the top adjustment member 136.

Figure 8:
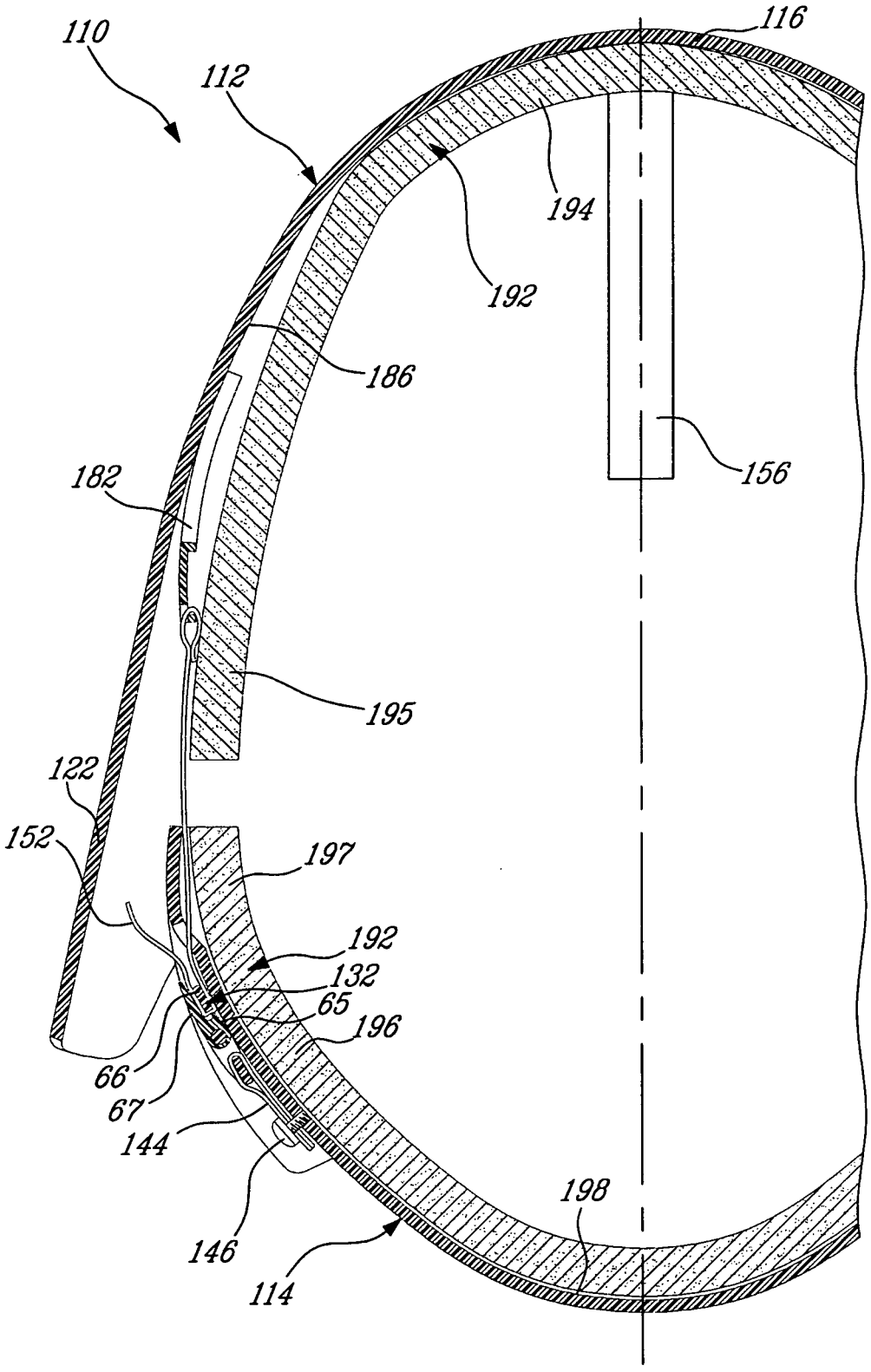
FIG. 8 is a cross-section of the goalie helmet of FIG. 5 shown with the inner padding layer.

Referring to FIG. 8, a particular embodiment of the upper left adjustment member 132 is shown and generally includes the same element as the adjustment member 32, the remaining adjustment members being identical to the upper left adjustment member 132. The adjustment member 132 is however used here in a different configuration as the strap 152 extends between the second fixed member 66 and the back plate 114, turns around the second fixed member 66 along the cam 65, and is pinched between the finger 67 and the second fixed member 66.

Referring to FIGS. 5-7, the left and right lower side straps 148, 150 extend from the respective adjustment member 128, 130 through a respective lower hole 170, 172 defined through the back plate 114, and are connected to the mask 112 in a similar manner as the lower side straps 48, 50.

Referring to FIGS. 6-7, the left and right upper side straps 152, 154 respectively extend from the left and right upper adjustment members 132, 134 through left and right upper holes 178, 180 defined through the back plate 114. The straps 152, 154 then extend along the inner surface of the back plate 114 and the inner surface of the mask 112. The left and right upper side straps 152, 154 each have a looped end respectively received through left and right connecting members 182, 184. The left and right connecting members 182, 184 are attached to the inner surface 186 of the mask 112 along a respective one of the side mask portions 122.

The top strap 156 extends from the top adjustment member 136 through a top hole 190 (see FIG. 6) defined through the back plate 114, along the inner surface of the back plate 114 and of the mask 112, and is attached directly, e.g. glued, to the inner surface 186 of the top mask portion 116 (see FIG. 7). Alternatively, the top strap 156 may be connected to a connection member retained to the inner surface 186 of top mask portion 116 (not shown).

The adjustment members 128, 130, 132, 134, 136 are preferably located in proximity of the respective back plate hole 170, 172, 178, 180, 190 such as to minimize a portion of the straps 148, 150, 152, 154, 156 extending along the outer surface of the back plate 114 and outside the helmet 110.

Referring to FIG. 8, the helmet 110 further includes an inner padding layer 192, which comprises a mask padding layer 194 secured to the inner surface 186 of the mask 112, and a back plate padding layer 196 secured to an inner surface 198 of the back plate 114. In a particular embodiment, the mask padding layer 194 is secured to the inner surface 186 of the mask 112 along a portion thereof only, and the back plate padding layer 196 is secured to the inner surface 198 of the back plate 114 along a portion thereof only. As such, free portions 195 of the mask padding layer 194 extending over the top mask portion 116 and the side mask portions 122 are free to move relative thereto, and free portions 197 of the back plate padding layer 196 are free to move relative to the back plate 114.

In an alternate embodiment, the mask padding layer 194 and back plate padding layer 196 are completely secured to the respective one of the mask 112 and back plate 114, i.e. the portions 195, 197 are either omitted or completely attached to the respective one of the mask 112 and back plate 114.

The helmet 110 can be made of material similar to that used for helmet 10.

The helmet 10, 110 described above advantageously has a back plate and a mask generally interconnected by upper and top straps which extend along an inner surface of the back plate and mask. Contrary to prior art helmets, the exposed portion of these straps is minimized as the portion of these straps defined between the back plate and the connection with the mask is completely contained inside the helmet, and the only part of these straps extending outside the helmet is the portion extending between the respective adjustment member and back plate hole. As such, the risk of the straps being subject to damage or becoming entangled during use is minimized.

The above description is meant to be exemplary only, and one skilled in the art will recognize that changes may be made to the embodiments described without departing from the scope of the invention disclosed. For example, the mask 12, 112 and back plate 14, 114 can be interconnected by more or less than five straps. The lower side straps 48, 148, 50, 150 can also be connected to the inner surface 86, 186 of the mask 12, 112. The adjustment members can be provided on other locations, for example along the length of the respective strap extending between the mask 12, 112 and back plate 14, 114. Still other modifications which fall within the scope of the present invention will be apparent to those skilled in the art, in light of a review of this disclosure, and such modifications are intended to fall within the appended claims.

The invention claimed is:

1. A goalie helmet comprising:

a mask adapted to cover a front portion of a head and extend below the eyes of a wearer, the mask including a window opening defined therethrough for minimizing an interference of the mask with a vision of the wearer, the window having a plurality of protection members extending thereacross;

a back plate comprising a separate element from the mask adapted to cover a rear portion of the head of the wearer, the back plate and the mask cooperating to substantially enclose the head of the wearer; and a plurality of straps interconnecting the back plate and the mask, at least one of the straps having one end engaged to a connecting member attached to an inner surface of the mask at a fixed location, the connecting member being concealed within the helmet when the helmet is worn by the wearer, the at least one of the straps having a first portion defined from the back plate to the connecting member, the first portion of the at least one of the straps being completely contained inside the helmet and completely concealed within the helmet when the helmet is worn by the wearer.

2. The goalie helmet as defined in claim 1, wherein the first portion extends between the inner surface of the mask and an inner padding layer resting against the inner surface of the mask.

3. The goalie helmet as defined in claim 1, wherein a second portion of the at least one of the straps defined adjacent the first portion extends along an inner surface of the back plate and is completely contained inside the helmet and concealed within the helmet when the helmet is worn by the wearer.

4. The goalie helmet as defined in claim 3, wherein the second portion extends between the inner surface of the back plate and an inner padding layer resting against the inner surface of the back plate.

5. The goalie helmet as defined in claim 3, wherein a third portion of the at least one of the straps defined adjacent the second portion is connected to an outer surface of the back plate, and passes through a respective hole defined through the back plate.

6. The goalie helmet as defined in claim 5, wherein the third portion is connected to the outer surface in proximity of the respective hole to minimize a length of the third portion.

7. The goalie helmet as defined in claim 1, wherein the straps are connected to the back plate through an adjustment mechanism allowing a length of the straps extending between the mask and the back plate to be changed.

8. The sports helmet as defined in claim 7, wherein the adjustment mechanism includes an adjustment member for each of the straps, each adjustment member including a pinching member pivotable between a closed position where the pinching member retains the strap to prevent the length from being changed, and an opened position where the pinching releases the strap to allow the length to be changed.

9. The goalie helmet as defined in claim 1, wherein the at least one of the straps includes a top strap extending between the back plate and the mask along top portions thereof.

10. The goalie helmet as defined in claim 1, wherein the at least one of the straps includes left and right side straps extending between the back plate and the mask respectively along left and right side thereof.

11. A sports helmet comprising:

a front shell adapted to cover a front portion of a head of a wearer including a face thereof;

a rear shell adapted to cover a rear portion of the head of the wearer, the rear shell cooperating with the front shell to surround the head; and the front and rear shells comprising separate elements being interconnected through a plurality of straps, at least one of the straps being connected to the front shell through a connecting member attached to an inner surface thereof at a fixed location, the connecting member being concealed within the helmet when the helmet is worn by the wearer, at least one of the straps having a portion defined from the rear shell to the connecting member with the portion being completely contained inside the helmet and concealed within the helmet when the helmet is worn by the wearer.

12. The helmet as defined in claim 11, wherein the portion of the at least one of the straps extends between the inner surface of the front shell and an inner padding layer resting against the inner surface of the front shell.

13. The goalie helmet as defined in claim 11, wherein the portion is a first portion, and a second portion of the at least one of the straps extending from the first portion extends along an inner surface of the rear shell and is completely contained inside the helmet and concealed within the helmet when the helmet is worn by the wearer.

14. The goalie helmet as defined in claim 13, wherein the second portion extends between the inner surface of the rear shell and an inner padding layer resting against the inner surface of the rear shell.

15. The goalie helmet as defined in claim 14, wherein a third portion of the at least one of the straps extending from the second portion passes through a hole defined through the rear shell and is connected to an outer surface of the rear shell.

16. The goalie helmet as defined in claim 15, wherein the third portion is connected to the outer surface in proximity of the hole to minimize a length of the third portion.

17. The goalie helmet as defined in claim 11, wherein the straps are connected to the rear shell through an adjustment mechanism allowing a length of the straps extending between the front and rear shells to be varied.

18. The sports helmet as defined in claim 17, wherein the adjustment mechanism includes an adjustment member for each of the straps, each adjustment member including a pinching member pivotable between a closed position where the pinching member retains the strap to prevent the length from being changed, and an opened position where the pinching releases the strap to allow the length to be changed.

19. The goalie helmet as defined in claim 11, wherein the at least one of the straps includes a top strap extending between the front and rear shells along top portions thereof.

20. The goalie helmet as defined in claim 11, wherein the at least one of the straps includes left and right side straps extending between the front and rear shells respectively along left and right side thereof.

* * * * *